US006435895B1

(12) United States Patent
Fink et al.

(10) Patent No.: US 6,435,895 B1
(45) Date of Patent: Aug. 20, 2002

(54) CONNECTOR POSITION ASSURANCE DEVICE

(75) Inventors: Randy L. Fink, Warren; Mauro R Jadue, Youngstown, both of OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/844,444

(22) Filed: Apr. 27, 2001

(51) Int. Cl.[7] ..... H01R 13/627; H01R 3/00; H01R 13/502

(52) U.S. Cl. ..... 439/352; 439/489; 439/701

(58) Field of Search ..... 439/352, 157, 439/347, 752, 575, 701, 488, 489

(56) References Cited

U.S. PATENT DOCUMENTS 5,378,168 A * 1/1995 Sumida ..... 439/358
5,380,217 A * 1/1995 Yagi et al. ..... 439/358
5,399,045 A * 3/1995 Yoneda et al. ..... 439/321
5,425,650 A * 6/1995 Maeda ..... 439/374
5,613,881 A * 3/1997 Ichida et al. ..... 439/680
5,711,684 A * 1/1998 Inoue et al. ..... 439/354
5,775,932 A * 7/1998 Saito et al. ..... 439/378
6,210,186 B1 4/2001 Fink et al. ..... 439/157
6,217,365 B1 * 4/2001 Shinozaki et al. ..... 439/358
6,234,826 B1 * 5/2001 Wilber et al. ..... 439/352
6,261,116 B1 * 7/2001 Ceru ..... 439/352
6,290,539 B1 * 9/2001 Wilber et al. ..... 439/595
6,312,277 B1 * 11/2001 Holub ..... 439/352

* cited by examiner

*Primary Examiner*—P. Austin Bradley
*Assistant Examiner*—Edwin A. León
(74) *Attorney, Agent, or Firm*—Thomas N. Twomey

(57) ABSTRACT

A CPA device located entirely on a first connector of a pair of interfitting connectors, wherein the CPA device is actuable only in the event that the two connectors are actually mated. A slide slides between a prestaged position and a staged position. The latter position is attained only upon release of a CPA actuation lock which automatically occurs upon mating of the connectors. The slide is then slid to the staged position, whereat the slide interferes with a clasp mechanism of the connectors so as to prevent unintentional release of the clasp mechanism.

12 Claims, 5 Drawing Sheets

CONNECTOR POSITION ASSURANCE DEVICE

TECHNICAL FIELD

The present invention relates to conductor connectors, and more particularly to connector position assurance devices therefor.

BACKGROUND OF THE INVENTION

Electrical, fiber optic and other types of connections are effected utilizing two mutually interfitting connectors, commonly in the form of mating male and female connectors. Each interfitting connector caries electrical, fiber optic or other conductors which are mutually situated and mutually configured so as to provide a connection therebetween when the interfitting connectors are mated to each other.

One problem that can arise is that the two intermitting connectors may not be fully mated, or may have been mated but have subsequently become dislodged from one another due to, for example, vibration. It is common practice, therefore, in the connector art to provide a connector position assurance (CPA) device which assures mating of the interfitting connectors.

An example of a pair of interfitting connectors having a CPA device is described in U.S. Pat. No. 6,210,186 B1. This example utilizes a pair of connectors, one connector having a CPA device and a slide assist cover which is connected with a U-shaped slide having partly angled slots, and the other connector having tabs. The two connectors are mated by first arranging the connectors so that the tabs enter the slots, and then sliding the slide assist cover to cause the slots to mate the connectors. The CPA device is then actuated. Interestingly, it is possible to move the slide assist cover and then actuate the CPA device even though the mating connector is absent.

While the aforementioned example works very well and is the epitome of slide assist type connectors, what remains needed in the connector art is a CPA device which is entirely located on one connector, yet is actuable only upon the connectors having actually mated.

SUMMARY OF THE INVENTION

The present invention is a CPA device located on one connector of a pair of interfitting connectors, wherein the CPA device is actuable only in the event that the two connectors are actually mated.

The CPA device according to the present invention is entirely located at one connector (the CPA connector). The CPA connector is provided with a CPA channel into which a CPA slide is located. The CPA slide interacts with the CPA channel snappingly at two sliding positions of the CPA slide relative to the channel: a prestaged position and a staged position.

A CPA actuation lock is provided, wherein the CPA channel includes a pair of channel abutments, and the CPA slide has a pair of resilient arms, the ends of which abut, respectively, the channel abutments when the CPA slide is at the prestaged position. The abutting interaction of the channel abutments with respect to the resilient arms prevents the CPA slide from being snappingly slid to the staged position.

As the CPA connector is mated to the other connector (the non-CPA connector), the non-CPA connector pushes upon the resilient arms so as to resiliently bend them out of abutment with respect to the channel abutments, thereby releasing the CPA actuation lock and allowing the CPA slide to be snappingly slid to the staged position.

Operationally, the CPA and non-CPA connectors share a clasp mechanism. Upon mating of the interfitting connectors, the CPA slide is free to be snappingly slid to the staged position, whereat the CPA slide interferes with the clasp mechanism so as to prevent unintentional release of the clasp mechanism.

Accordingly, it is an object of the present invention to provide a CPA device located on one connector of a pair of interfitting connectors, wherein the CPA device is actuable only in the event that the two connectors are actually mated.

This and additional objects, features and advantages of the present invention will become clearer from the following specification of a preferred embodiment.

DESCRIPTION OF THE PREFERRED EMBODIMENT

Figure 1:
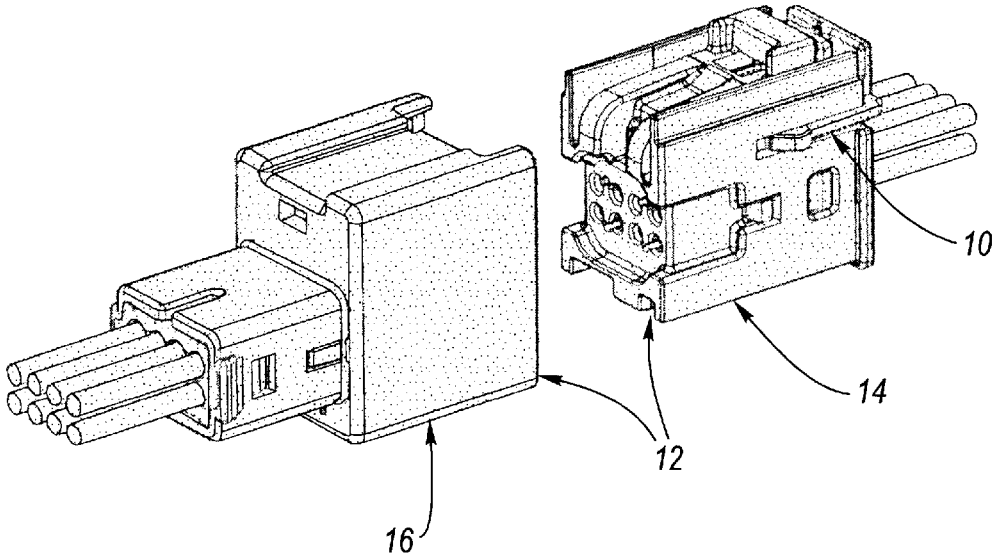
FIG. 1 is a perspective view of two interfitting connectors, one of which is equipped with the CPA device according to the present invention.

Referring now to the Drawing, FIGS. 1 through 11 depict an example of a CPA device 10 according to the present invention. In this regard, FIG. 1 depicts an exemplar environment of use of the CPA device 10 with respect to two interfitting connectors 12. One of the connectors is a CPA connector 14, in that the CPA device 10 is located thereat. The other connector is a non-CPA connector 16, in that none of the CPA device is located thereat. The interfitting connectors 12 may be any form of connectors, as for example those used in the electrical arts to connect wires or in the fiber optic arts to connect fiber optic fibers.

Figure 2:
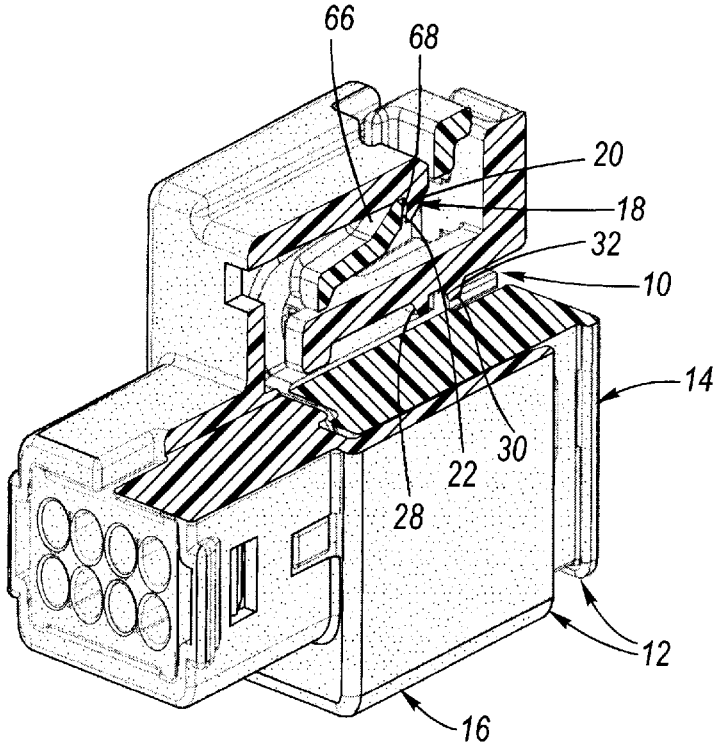
FIG. 2 is a partly sectional perspective view of the two interfitting connectors of FIG. 1, shown mated, and wherein the CPA slide is at the prestaged position.

As shown at FIG. 2, the exemplified interfitting connectors 12, are mutually configured so that the CPA connector 14 is matingly received into the non-CPA connector 16. The two exemplified interfitting connectors 12 are held in a mated state by a clasp mechanism 18, having, for example, the following clasp elements: a boss 20 of the non-CPA connector 16 being received into a mating slot 22 formed in a resiliently mounted land of the CPA connector 14. In this exemplification, the CPA device 10 serves to retain the boss 20 in the mating slot 22, and is operable to provide this feature once the interfitting connectors 12 are mated.

Figure 3:
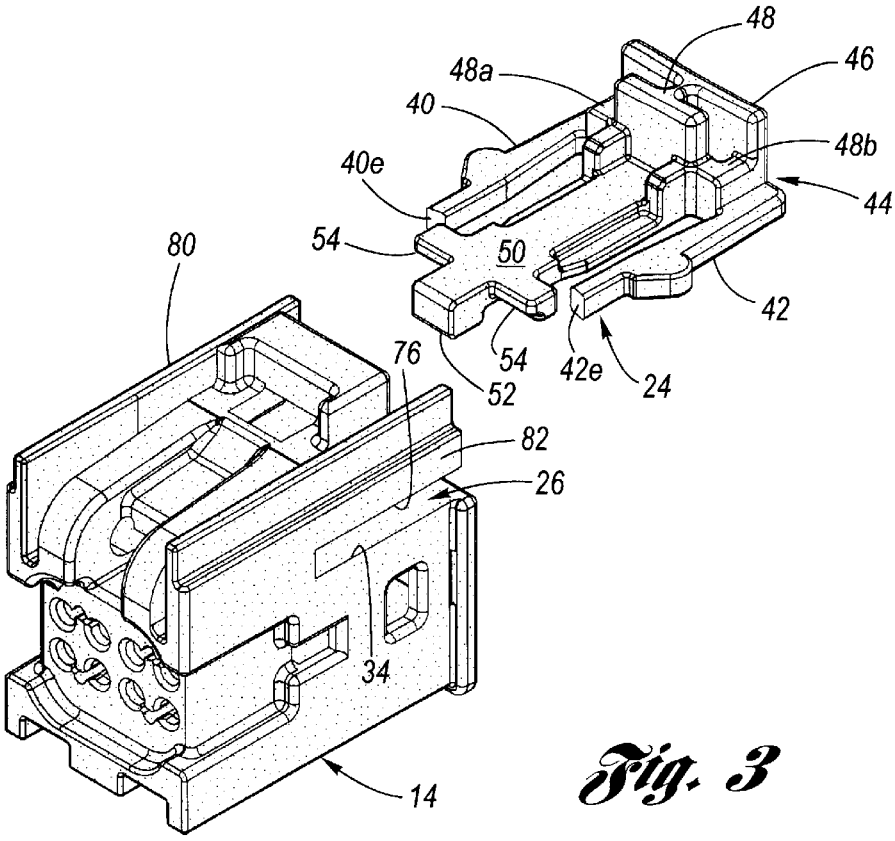
FIG. 3 is a perspective view of the CPA connector of the two interfitting connectors and the CPA slide therefor.
Figure 4:
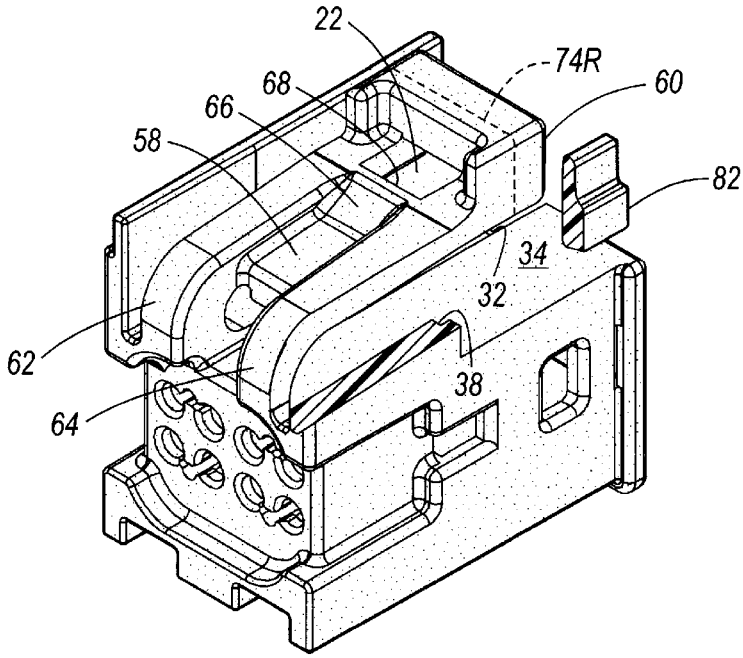
FIG. 4 is a partly sectional perspective view of the CPA connector of FIG. 3.

FIG. 3 shows the aforementioned CPA device 10, which includes a CPA slide 24 and a CPA channel 26 formed in the body of the CPA connector 14. The CPA slide 24 is slidably located in the CPA channel 26, as generally exemplified at FIG. 2, wherein a bottom surface of the CPA slide has first and second lips 28, 30 which must be snappingly moved over a rib 32 formed at a groove 34*g* of the floor 34 of the CPA channel. Accordingly, the CPA slide 24 is retained in the CPA channel 26 provided the first lip 28 has passed over the rib 32. With the rib 32 located between the first and second lips 28, 30, the CPA slide is at its prestaged position with respect to the CPA connector 14, as shown at FIG. 2.

Figure 5:
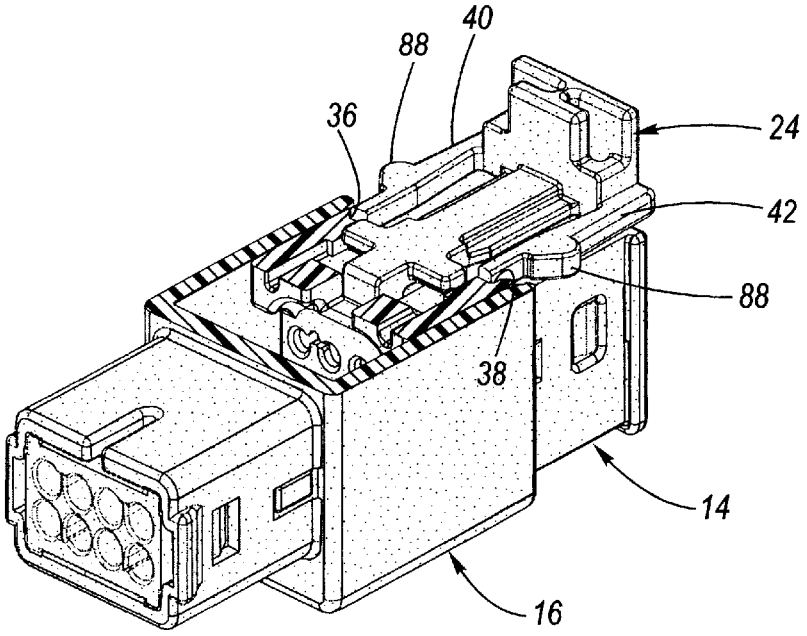
FIG. 5 is a partly sectional perspective view of the two interfitting connectors, wherein the CPA slide is at the prestaged position.

A CPA actuation lock is in the form of the CPA channel 26 having a pair of channel abutments 36, 38 (see FIGS. 4, 5 and 6), and the CPA slide having a pair of resilient arms 40, 42 (see FIGS. 3 and 7), wherein the arm ends 40*e*, 42*e* of the resilient arms abut, respectively, the channel abutments 36, 38 when the CPA slide is at the prestaged position (see FIG. 5). The abutting interaction of the channel abutments 36, 38 with respect to the arm ends 40*e*, 42*e* prevents the CPA slide 24 from being snappingly slid in the direction of the second lip 30 over the rib 32 to its staged position, as shown at FIG. 10. To enhance the aforementioned abutting function of the CPA actuation lock, the ends 40*e*, 42*e* and the channel abutments 36, 38 are acutely inclined relative to each other, the inclination angle θ, preferably of about 5 degrees, being such as to tend to inhibit the resilient arms from flexing inwardly toward each other (see FIG. 9).

Returning to the CPA slide 24 as shown best at FIG. 3, the CPA slide further has a head 44 which includes a rear wall 46, a primary CPA abutment 48 and a pair of secondary CPA abutments 48*a*, 48*b* on either side thereof. The resilient arms 40, 42 are attached to the head 44. The CPA slide further features a central body 50 which is connected with the head 44, and terminates forwardly of the resilient arms in the form of a post 52 and a pair of cross-arms 54.

Returning now to the interfitting connectors 12, the boss 20 of the non-CPA connector 16 has a leading edge 56*a* which is inclined and has a following edge 56*b* which is perpendicular (see FIG. 10). The mating slot 22 of the CPA connector is formed in a (previously mentioned) land 58 which is resiliently connected to the CPA connector adjacent the rear end of the floor 34. The land 58 terminates in a header 60. The preferred resilient connection of the land 58 (and the header 60) is in the form of two mutually spaced apart curved legs 62, 64 which connect to the land on either side thereof. On the land 58 is an inclined ramp 66 which adjoins the mating slot 22 and terminates at a slot edge 68. Accordingly, as the CPA and non-CPA connectors 14, 16 are mated, the leading edge 56*a* of the boss 20 rides up the inclined ramp 66 (creating a resilient compression at the curved legs 62, 64) and then snappingly enters the mating slot 22 as the header springs upwardly when the boss falls off the inclined ramp and into the mating slot. Now, the interfitting connectors 12 are held in the mated state by an interfering abutment of the following edge 56*b* of the boss 20 against the slot edge 68 of the mating slot 22. To release the mating, the header 60 must be depressed so that the boss clears the slot edge of the inclined ramp. The CPA device 10 selectively presents this from happening by the CPA slide 24 being slid to its staged position whereat the CPA slide prevents the header from being depressed.

Figure 6:
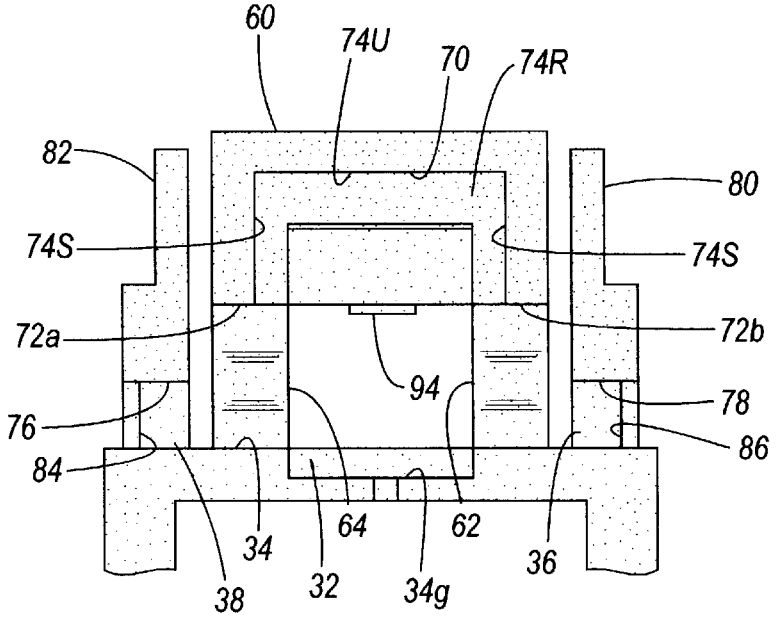
FIG. 6 is a broken-away front end view of the CPA connector.
Figure 11:
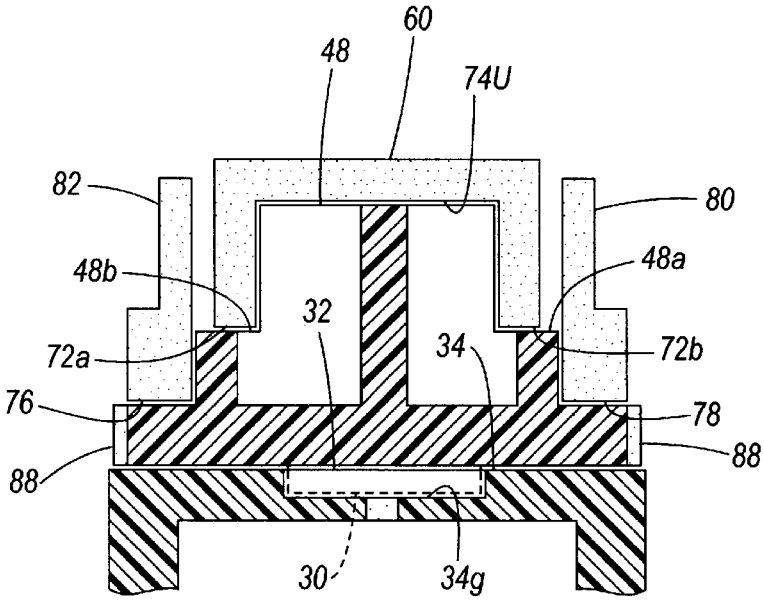
FIG. 11 is a view of the CPA connector similar to that of FIG. 6, wherein the CPA slide is shown at its staged position.

Referring particularly to FIG. 6, the header 60 has a primary slide seat 70 into which the primary CPA abutment 48 is receivable and secondary slide seats 72*a*, 72*b* on either side of the primary slide seat which receives the secondary CPA abutments 48*a*, 48*b* (see FIG. 11). The primary slide seat 70 is in the form of an open-bottom recess demarcated by a U-shaped recess wall 74R an upper recess wall 74U and side recess walls 74S.

Now referring to FIGS. 3 and 6, it will be noted that the CPA channel 26 includes guide slots 76, 78 formed, respectively, in siderails 80, 82. The guide slots 76, 78 terminate, respectively, at the channel abutments 36, 38. A guide tab 84, 86 is provided at each of the guide slots 76, 78. As indicated additionally by FIG. 5, the CPA channel 26 is structured so that the CPA slide 24 slides along the floor 34 with the first and second lips 28, 30 being situated in the groove 34*g*, and so that the resilient arms 40, 42 are situated in the guide slots 76, 78, wherein nibs 88 of the resilient arms protrude.

Referring now in particular to FIGS. 7 through 11, operation will be discussed.

Figure 7:
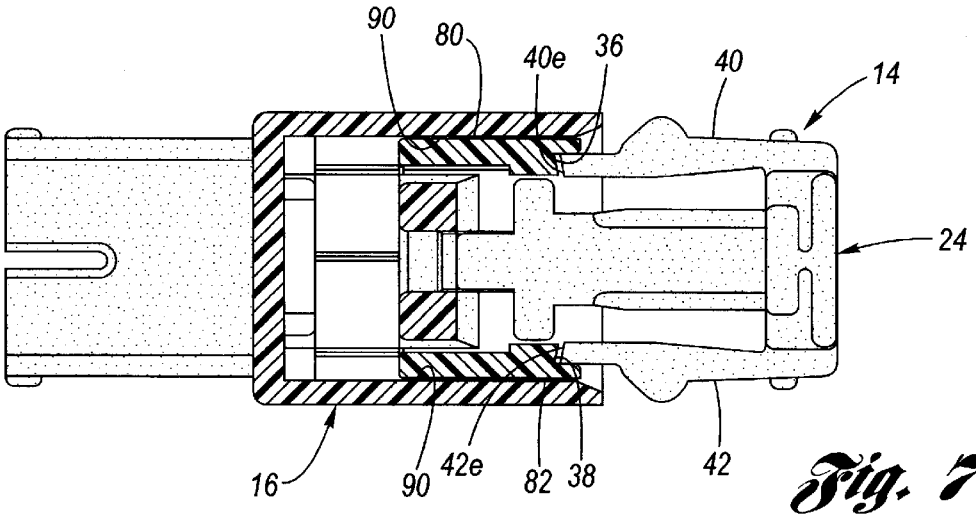
FIG. 7 is a partly sectional top view of the two interfitting connectors, shown at the position depicted at FIG. 5, wherein the CPA actuation lock is active.

At FIG. 7, the CPA connector 14 has been partly inserted into a mating port of the non-CPA connector 16, wherein port sidewalls 90 of the non-CPA connector abut the siderails 80, 82. The CPA slide is at the prestaged position.

Figure 8:
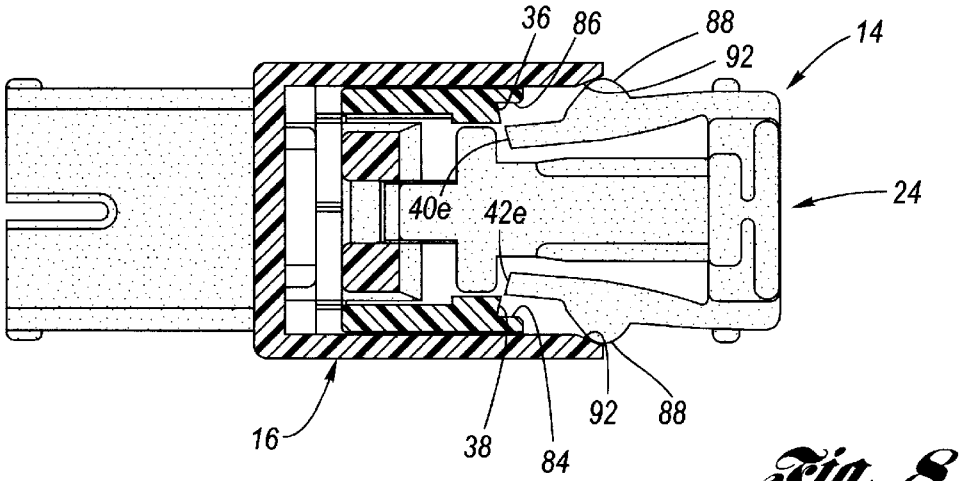
FIG. 8 is a partly sectional top view of the two interfitting connectors, shown whereat the CPA actual lock has released.

At FIG. 8, the CPA connector is further inserted into the mating port, during which the nibs 88 come into abutment with an entry bevel 92 of the port sidewalls 90. Still further insertion results in the nibs 88 being forced inwardly by the sidewalls, which is possible because of flexing by the resilient arms 40, 42. The flexing of the resilient arms 40, 42 results, in turn, with the arms ends 40*e*, 42*e* being moved out of an interfering abutment with the channel abutments 36, 38. The CPA slide continues to remain at the prestaged position.

Figure 9:
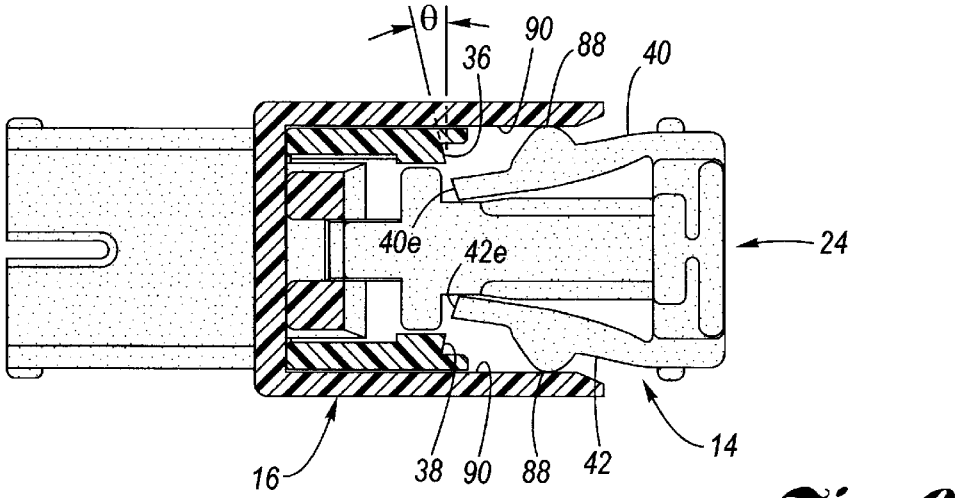
FIG. 9 is a partly sectional top view of the two interfitting connectors, shown fully mated.
Figure 10:
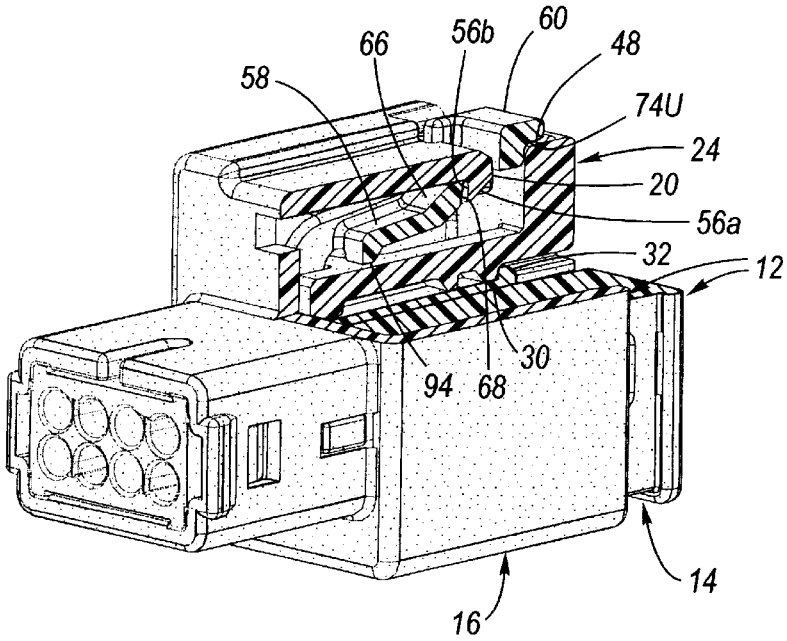
FIG. 10 is a partly sectional perspective view of the two interfitting connectors, shown mated and with the CPA slide at the staged position.

At FIG. 9, the CPA connector 14 is fully mated with the non-CPA connector, and the resilient arms 40, 42 are flexed inwardly so as to be well clear of channel abutments 36, 38. The CPA slide still remains at the prestaged position.

Simultaneously during the movements indicated at FIGS. 7 through 9, the boss 20 has traveled along the inclined ramp 66, causing the header 60 to be resiliently flexed downwardly (toward the floor 34) until the boss has cleared the slot edge 68, whereupon the header springs upwardly and traps the boss in the slot 22, as depicted at FIG. 2.

In order to prevent flexing of the header 60, which effectively causes the two interfitting connectors 12 to be assuredly locked together in the mating position, the CPA slide 24 is slid toward the non-CPA connector 16 to the staged position, whereupon the second lip 30 has snapped over the rib 32, as shown at FIG. 10. Now, at the staged position, the primary CPA abutment 48 is received into the primary slide seat 70 of the header such that the header cannot be flexed toward the floor because of the interfering abutment of the primary CPA abutment with respect to the upper recess wall 74U. Additionally, at the staged position of the CPA slide, the secondary CPA abutments 48*a*, 48*b* interferingly abut, respectively, the secondary slide seats 72*a*, 72*b* which also serve to prevent flexing of the header toward the floor (see FIG. 11, wherein parts spacing is shown emphasized for clarity).

As the CPA slide 24 achieves the staged position, the primary CPA abutment 48 applies a force on the header 60 tending to flex it upwardly (away from the floor 34) as the second lip 30 snaps over the rib 32 (as also happened when the first lip 28 passed over the rib 32). In this regard, the header 60 is held from moving upwardly to any substantial amount by the boss 20, which also serves to assist prevention of the second lip 30 from backing out over the rib 32. Indeed, intentional prying is necessary to extract the CPA slide 24 from the staged position. A lug 94 (see FIG. 10) is located on the land 58 adjacent the curved legs 62, 64 which serves as a hold-down for the CPA slide 24 at the post 52 thereof. At the staged and prestaged positions of the CPA slide 24, the ends of the cross-arms 54 guidably abut the siderails 80, 82 and the post 52 is located guidably between the curved legs 62, 64. When the CPA slide 24 achieves the staged position, the cross-arms 54 abut the curved legs 62, 64.

It is to be noted that the entire CPA device 10 is located on the CPA connector 14, and further that the CPA slide is prevented from moving unless the two interfitting connectors 12 are mated. These features provide connector mating position assurance, wherein manufacturing is simplified by the entire CPA device being located on a single one of the connectors.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. In a pair of interfitting first and second connectors selectively held in a mutually mated relationship by a clasp mechanism connected to the first and second connectors, the improvement thereto comprising: a connector position assurance device connected to the first connector, said connector position assurance device comprising:

a slide slidable with respect to the first connector from a prestaged position to a staged position, wherein when said slide is at said prestaged position said clasp mechanism is operable between a clasped position for holding the first and second connectors at the mutually mated relationship and an unclasped position whereat the first and second connectors may enter into and be exited from the mutually mated relationship, and wherein when said slide is at said staged position said clasp mechanism is retained in the clasped position; and a connector position assurance actuation lock having a locked state and unlocked state, wherein said slide is only slidable to said staged position when said connector position assurance actuation lock is in the unlocked state, and wherein said unlocked state occurs only when the first and second connectors are mutually mated;

wherein said connector position assurance actuation lock comprises:

the first connector having a channel formed therein which defines a pair of acutely angled channel abutments; and a pair of resilient arms located on said slide, each said arm terminating in an acutely angled arm end;

wherein said slide is slidable in said channel between said prestaged and staged positions; and wherein said locked state is defined by said acutely angled arm ends abutting said acutely angled channel abutments wherein an inclination angle of the acutely angled arm ends and channel abutments inhibits said pair of resilient arms from flexing inwardly toward each other, and wherein said unlocked state is defined by said resilient arms being resiliently bent out of abutment with said channel abutments by abutment with the second connector when said first and second connectors are mutually mated.

2. The connectors of claim 1, wherein the clasp mechanism comprises a boss on said second connector being selectively received into a mating slot formed in a land resiliently connected to the first connector, said land being resiliently moved by said boss as said boss enters and exits said mating slot; wherein said connector position assurance device further comprises an abutment connected to said slide; wherein at said staged position said abutment prevents said land from being resiliently moved by said boss.

3. The connectors of claim 2, wherein said channel further defines a pair of guide slots, each guide slot terminating at a respective said channel abutment; wherein said resilient arms each have a nib formed thereon; and wherein said resilient arms are located in said guides slots such that said nibs protrude therefrom so as to be abutted by said second connector when said first and second connectors are mated, thereby causing said arm ends to be placed out of abutment with said channel abutments.

4. The connectors of claim 3, wherein said prestaged position is defined by a first snapping interaction between said slide and said first connector, and wherein said staged position is defined by a second snapping interaction between said slide and said first connector.

5. The connectors of claim 4, wherein said first and second snapping interactions are directed oppositely with respect to said boss relative to said land.

6. The connectors of claim 5, wherein a header is connected to said land such that said header is constrained to move with said land, said header having a seat formed therein; wherein at said staged position, said abutment of said slide is received in said seat.

7. The connectors of claim 6, wherein at said staged position said boss biases said a header, and, in turn, said slide by said header, in a direction oppositely in relation to said second snapping interaction.

8. A first connector for being mated to a second connector, said first connector comprising:

a connector body;

a clasp element resliently mounted to said connector body; and a connector position assurance device comprising:

a slide slidable relative to said connector body from a prestaged position to a staged position, wherein when said slide is at said prestaged position said clasp element is resiliently movable in a predetermined direction and when at said staged position said clasp element is immovable in the predetermined direction; and a connector position assurance actuation lock having a locked state and unlocked state, wherein said slide is only slidable to said staged position when said connector position assurance actuation lock is in the unlocked state, and wherein said unlocked state occurs only when the first and second connectors are mutually mated;

wherein said prestaged position is defined by a first snapping interaction between said slide and said first connector, and said staged position is defined by a second snapping interaction between said slide and said first connector; and wherein said first and second snapping interactions are directed oppositely with respect to said predetermined direction.

9. The connector of claim 8, wherein said connector position assurance actuation lock comprises:

a channel formed in said connector body which defines a pair of channel abutments; and a pair of resilient arms located on said slide, each said arm terminating in an arm end;

wherein said slide is slidable in said channel between said prestaged and staged positions; and wherein said locked state is defined by said arm ends abutting said channel abutments, and said unlocked state is defined by said resilient arms being resiliently bent out of abutment with said channel abutments by abutment with the second connector when said first and second connectors are mutually mated.

10. The connector of claim 9, wherein the clasp element comprises a land resiliently connected to the connector body; wherein said connector position assurance device further comprises an abutment connected to said slide; wherein at said staged position said abutment prevents said land from being resiliently moved in the predetermined direction.

11. The connector of claim 10, wherein said channel further defines a pair of guide slots, each guide slot terminating at a respective said channel abutment; wherein said resilient arms each have a nib formed thereon; and wherein said resilient arms are located in said guides slots such that said nibs protrude therefrom so as to be abutted by the second connector when said first and second connectors are mated, thereby causing said arm ends to be placed out of abutment with said channel abutments.

12. The connector of claim 11, wherein a header is connected to said land such that said header is constrained to move with said land, said header having a seat formed therein; wherein at said staged position, said abutment of said slide is received in said seat.

* * * * *